US009803312B2

(12) United States Patent
Chung et al.

(10) Patent No.: US 9,803,312 B2
(45) Date of Patent: Oct. 31, 2017

(54) DRYER WITH HEAT PUMP

(71) Applicant: LG Electronics Inc., Seoul (KR)

(72) Inventors: Youngsuk Chung, Gyeongsangnam-do (KR); Donggeun Lee, Gyeongsangnam-do (KR); Myoungjong Kim, Gyeongsangnam-do (KR)

(73) Assignee: LG Electronics Inc., Seoul (KR)

( * ) Notice: Subject to any disclaimer, the term of this patent is extended or adjusted under 35 U.S.C. 154(b) by 494 days.

(21) Appl. No.: 14/086,000

(22) Filed: Nov. 21, 2013

(65) Prior Publication Data

US 2014/0137423 A1 May 22, 2014

(30) Foreign Application Priority Data

Nov. 21, 2012 (KR) ..... 10-2012-0132566

(51) Int. Cl.
*F26B 19/00* (2006.01)
*D06F 58/20* (2006.01)
*D06F 58/02* (2006.01)

(52) U.S. Cl.
CPC ..... *D06F 58/206* (2013.01); *D06F 58/02* (2013.01); *D06F 58/20* (2013.01)

(58) Field of Classification Search
CPC ..... D06F 58/26; D06F 58/206; D06F 5/2068; D06F 58/00; D06F 58/02; D06F 58/04; D06F 58/06; D06F 58/10; D06F 58/20; D06F 58/203; D06F 58/24; D06F 58/263
USPC ..... 34/86, 114, 115, 108, 109
See application file for complete search history.

(56) References Cited

U.S. PATENT DOCUMENTS 3,877,152 A * 4/1975 Gorman ..... D06F 58/203 34/524
4,621,438 A * 11/1986 Lanciaux ..... D06F 58/04 34/242
7,024,795 B2 4/2006 Tadano
7,900,372 B2 * 3/2011 Prajescu ..... D06F 58/04 211/26

(Continued)

FOREIGN PATENT DOCUMENTS

CN 1580376 A 2/2005
CN 101259362 A 9/2008

(Continued)

OTHER PUBLICATIONS

European Search Report dated Aug. 6, 2014 for European Application No. 13193682.5, 8 pages.

(Continued)

*Primary Examiner* — John McCormack
(74) *Attorney, Agent, or Firm* — Fish & Richardson P.C.

(57) ABSTRACT

A dryer with a heat pump that includes a cabinet, a drum installed within the cabinet, and an exhaust duct configured to exhaust air from the drum to outside of the cabinet. The dryer also includes a fan configured to inhale air from the drum and pump the air to the exhaust duct, an evaporator configured to exchange heat with air being exhausted through the exhaust duct, and a condenser disposed at a rear side of the drum. The dryer further includes an intake passage member configured to guide air that has passed through the condenser into the drum and a compressor and an expansion apparatus configured to define a heat pump along the evaporator and condenser.

16 Claims, 5 Drawing Sheets

(56) References Cited

U.S. PATENT DOCUMENTS

| | | | | |
|---|---|---|---|---|
| 2004/0094288 | A1* | 5/2004 | Hoyle | F28F 9/0251 165/41 |
| 2005/0044744 | A1 | 3/2005 | Tadano | |
| 2008/0041077 | A1* | 2/2008 | Tutunoglu | F25D 19/00 62/186 |
| 2008/0216341 | A1 | 9/2008 | Mukaiyama | |
| 2008/0217324 | A1* | 9/2008 | Abbott | C23C 4/06 219/538 |
| 2010/0043245 | A1* | 2/2010 | Noviello | D06F 58/26 34/60 |
| 2010/0132216 | A1* | 6/2010 | Krausch | D06F 58/02 34/443 |
| 2010/0199512 | A1 | 8/2010 | Tomochika | |
| 2010/0257748 | A1 | 10/2010 | Steffens et al. | |
| 2012/0079735 | A1 | 4/2012 | Lee | |
| 2012/0144693 | A1 | 6/2012 | Wakizaka | |
| 2013/0092150 | A1* | 4/2013 | Halverson | F24C 3/002 126/523 |

FOREIGN PATENT DOCUMENTS

| | | | |
|---|---|---|---|
| CN | 101802291 | A | 8/2010 |
| DE | 102007061041 | A1 | 6/2009 |
| EP | 1 967 641 | A1 | 9/2008 |
| EP | 2 163 830 | A2 | 3/2010 |
| EP | 2 199 452 | A1 | 6/2010 |
| EP | 2 466 000 | A1 | 6/2012 |
| JP | 54-175172 | A | 12/1979 |
| JP | 57-039534 | A | 3/1982 |
| JP | 57-131493 | A | 8/1982 |
| JP | 60-132600 | A | 7/1985 |
| JP | 60-242898 | A | 12/1985 |
| JP | 2008-215756 | A | 9/2008 |
| JP | 2009-0072372 | A | 4/2009 |
| JP | 2010-094206 | A | 4/2010 |
| JP | 2012-125352 | A | 7/2012 |
| WO | WO 2005/064069 | A2 | 7/2005 |

OTHER PUBLICATIONS

Chinese Office Action dated Jul. 27, 2015 for Chinese Application No. 201310594384.X, with English translation, 17 Pages.

Japanese Office Action dated Jan. 6, 2015 for Japanese Application No. 2013-239970, with English Translation, 6 pages.

* cited by examiner

DRYER WITH HEAT PUMP

CROSS-REFERENCE TO RELATED APPLICATIONS

The present application claims priority to Korean Application No. 10-2012-0132566, filed on Nov. 21, 2012, which is herein expressly incorporated by reference in its entirety.

FIELD

The present disclosure relates to a dryer with a heat pump.

BACKGROUND

In general, a clothes treating apparatus having a drying function, such as a washer or dryer, is a device for receiving laundry in a drum in a state that washing is completed. The clothes treating apparatus terminates the dehydration process, and supplies hot air into the drum to evaporate moisture of the laundry, thereby drying the laundry.

For example, a dryer may include a drum rotatably provided within a cabinet to receive laundry, a drive motor configured to drive the drum, a blower fan configured to blow air into the drum, and a heating device configured to heat air brought into the drum. Furthermore, the heating device may use high-temperature electric resistance heat generated using an electric resistance, or combustion heat generated by combusting gas.

Air discharged from the drum contains the moisture of the laundry, and thus becomes high temperature and humid air. Dryers may be classified according to a method for processing the high temperature and humid air, and thus divided into a condensation (circulation) type dryer for condensing moisture contained in the high temperature and humid air by cooling the air below the dew point temperature through a condenser while being circulated without discharging the high temperature and humid air out of the dryer, and an exhaustion type dryer for directly discharging the high temperature and humid air having passed through the drum to the outside.

For the condensation type dryer, in order to condense air discharged from the drum, the process of cooling the air below the dew point temperature may be carried out to heat the air through the heating device prior to being supplied to the drum again. Here, the loss of heat energy contained in the air is generated while being cooled down during the condensation process, and an additional heater or the like is required to heat the air to a temperature required for drying.

For the exhaustion type dryer, the dryer discharges high temperature and humid air to the outside and receives outside air at normal temperature, thereby heating the air up to a required temperature level through the heating device. In particular, thermal energy transferred by the heating device is contained in high temperature air being discharged to the outside, but it is discharged and wasted to the outside, thereby reducing the thermal efficiency.

Accordingly, in recent years, clothes treating apparatuses for collecting energy required to generate hot air and energy being discharged to the outside without being used have been introduced to increase energy efficiency, and a clothes treating apparatus having a heat pump system has been introduced as an example of the clothes treating apparatus. The heat pump system may include two heat exchangers, a compressor and an expansion apparatus, and energy contained in the discharged hot air is reused in heating up air being supplied to the drum, thereby increasing energy efficiency.

Specifically, in the heat pump system, an evaporator is provided at the exhaust side, and a condenser at an inlet side of the drum, and thus thermal energy is transferred to refrigerant through the evaporator and then thermal energy contained in the refrigerant is transferred to air brought into the drum, thereby generating hot air using waste energy. Here, a heater for reheating air that has been heated up while passing through the evaporator may be additionally provided therein.

SUMMARY

According to an aspect of the present disclosure, a dryer includes a cabinet; a drum installed within the cabinet and including an opening that receives objects to be dried; an exhaust duct configured to exhaust air from the drum to outside of the cabinet; a fan configured to inhale air from the drum and pump the air to the exhaust duct; an evaporator configured to exchange heat with air being exhausted through the exhaust duct; a condenser disposed behind a rear side of the drum that is opposite of a front side of the drum in which the opening is defined; an intake passage having an inlet configured to inhale air that has passed through the condenser into the drum; and a compressor and an expansion apparatus configured to define a heat pump along the evaporator and condenser.

According to another aspect of the present disclosure, a dryer includes a cabinet; a drum installed within the cabinet and including an opening that receives objects to be dried; a condenser installed behind a rear side of the drum that is opposite of a front side of the drum in which the opening is defined, the condenser being configured to heat air inhaled from a rear surface of the cabinet; a fan disposed under a lower side of the drum and configured to inhale and exhaust air within the drum; a fan housing that accommodates the fan and communicates with the drum; an evaporator housing coupled to the fan housing and configured to guide the exhausted air out of the cabinet; a compressor housing disposed at one side of the evaporator housing; an evaporator accommodated in the evaporator housing and configured to exchange heat with air being guided by the evaporator housing; and a compressor accommodated in the compressor housing.

Implementations may include one or more of the following features. For example, the condenser may be disposed between a rear surface of the drum and a rear surface of the cabinet. In addition, the condenser may be disposed in an inclined manner relative to a rear surface of the drum or a rear surface of the cabinet.

In some implementations, the condenser may be disposed on a rear surface of the drum or a rear surface of the cabinet. In these implementations, the dryer may include a bracket configured to fix the condenser to the rear surface of the drum or the rear surface of the cabinet.

In some examples, the dryer may include an intake passage member located at the rear side of the drum and configured to define the intake passage. In these examples, the intake passage member may include a plate member disposed to face a rear surface of the drum and define an intake passage between the rear surface of the drum and the plate member, the inlet being defined in the plate member. Further, in these examples, the dryer may include a supporting member configured to support the plate member and the supporting member may be supported within the cabinet.

In some implementations, the dryer may include an evaporator housing that houses the evaporator and that is fixed to a bottom surface of the cabinet and a compressor housing that houses the compressor and that is fixed to the bottom surface of the cabinet. In these implementations, the supporting member may include a pair of fixing brackets that extend along a height direction of the cabinet. The pair of fixing brackets may be fixed to the evaporator housing or compressor housing, respectively.

In addition, the condenser maybe installed within the intake passage. The condenser also may be installed at an inner side of the inlet or at a front end of the inlet. A plurality of slits may be defined in a rear surface of the cabinet and air may enter the cabinet through the plurality of slits, pass through the condenser, and enter the intake passage after passing through the condenser.

In some examples, the dryer may include a heating member installed within the intake passage. In these examples, the heating member may be disposed at a downstream side of the condenser and may be configured to further heat air that has been heated by the condenser. Further, in these examples, the heating member may be disposed in an inclined manner relative to a rear surface of the drum or a rear surface of the cabinet.

In some implementations, the dryer may include a plate member disposed to face a rear surface of the drum and define an intake passage, an inlet configured to inhale air that has passed through the condenser into the drum may be defined in the plate member, and the condenser may be installed at the intake passage. In these implementations, the dryer may include a pair of fixing brackets fixed to the evaporator housing or compressor housing, respectively, and configured to support the plate member. Also, in these implementations, the dryer may include a bracket fixing portion to which the pair of fixing brackets are inserted and fixed, the bracket fixing portion being located in the evaporator housing or compressor housing.

An outer circumferential portion of the plate member may be brought into contact with a rear surface of the drum. The plate member may be fixed to the rear surface of the drum or the rear surface of the cabinet.

In some examples, the dryer may include a heater installed within the intake passage and configured to further heat air heated by the condenser. In these examples, the dryer may include a heater installation portion that accommodates the heater and that is located at an upper side of the inlet.

DETAILED DESCRIPTION

Figure 1:
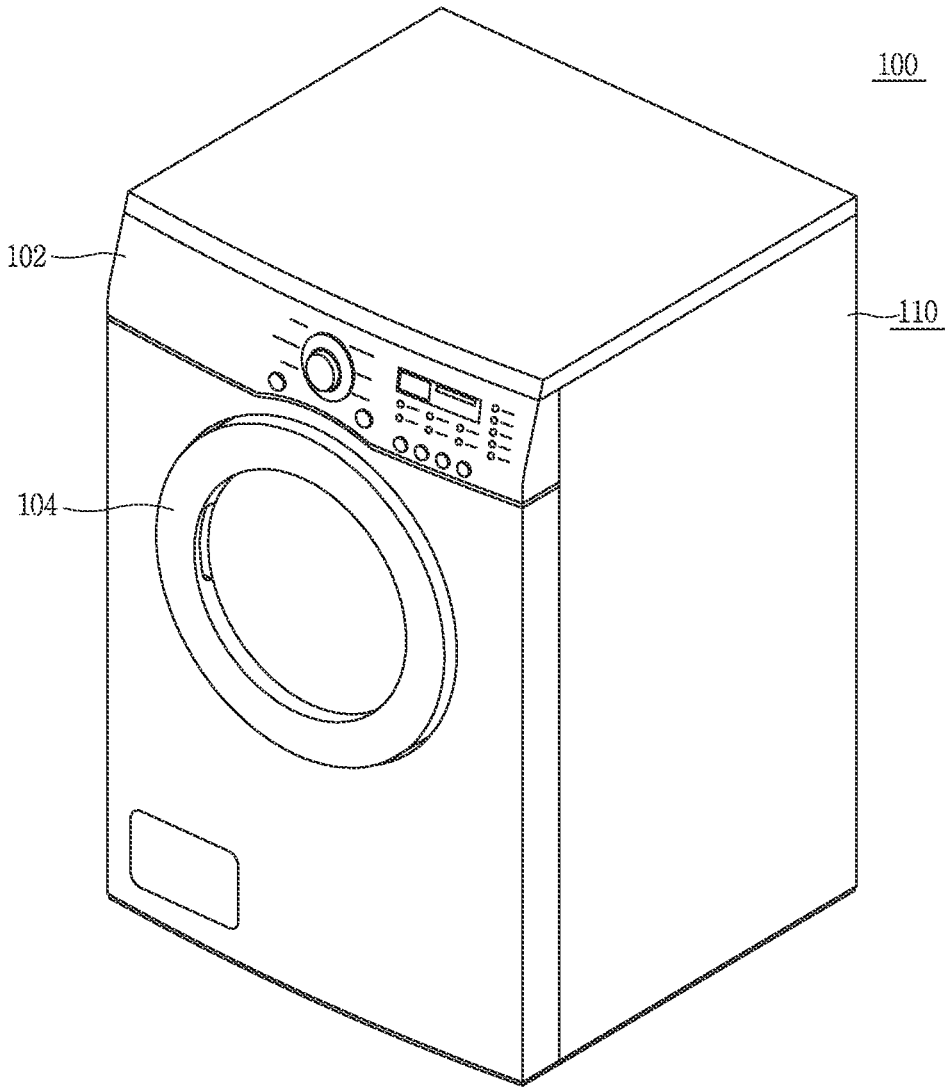
FIG. 1 is a perspective view illustrating an example dryer.
Figure 2:
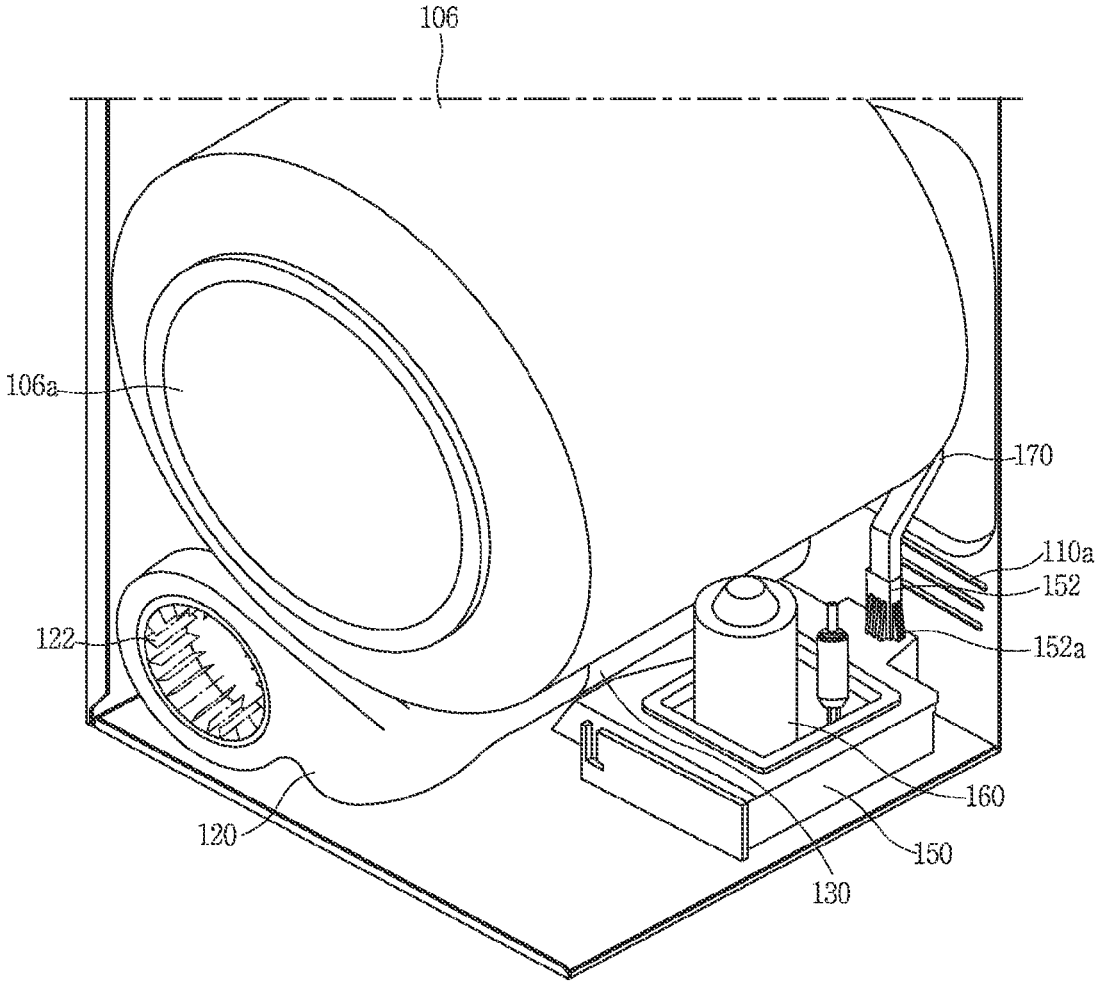
FIG. 2 is a perspective view illustrating the internal structure of the example dryer.
Figure 3:
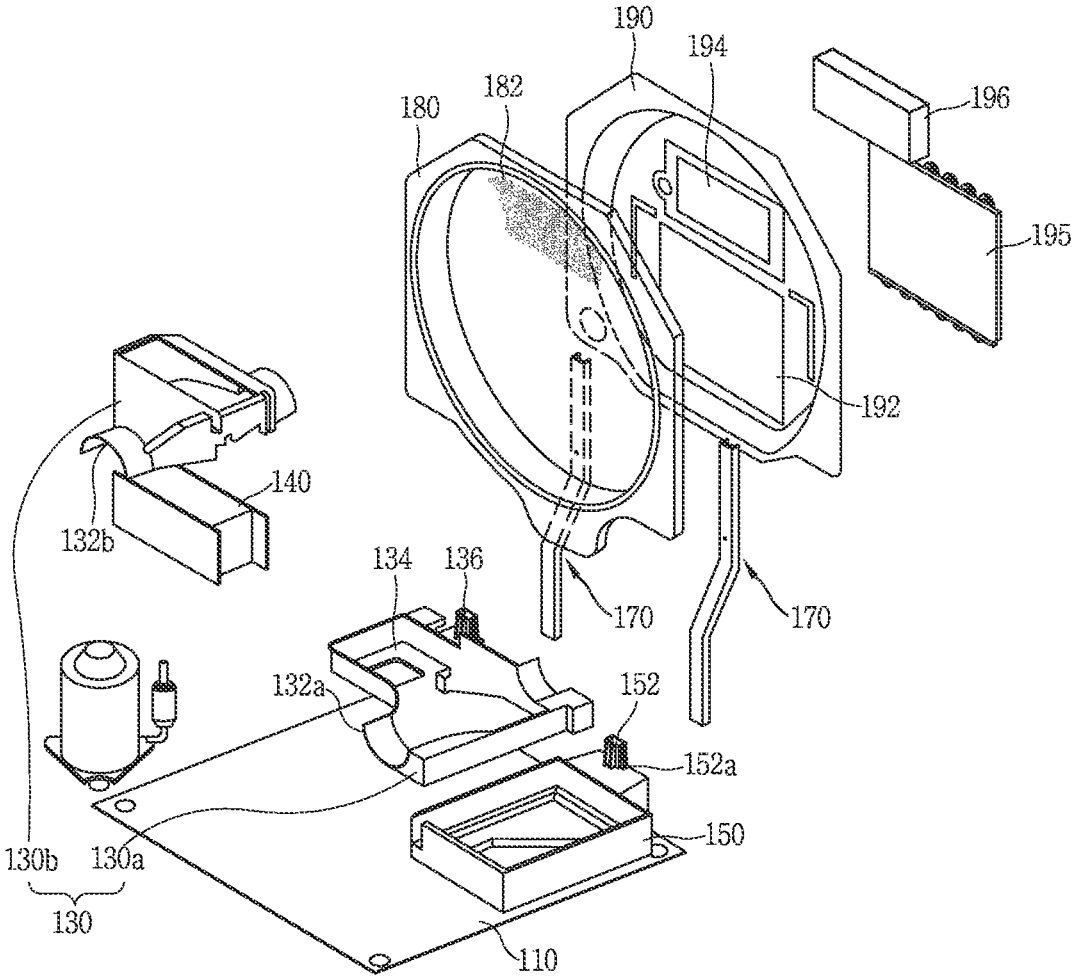
FIG. 3 is an exploded perspective view illustrating the internal structure of the example dryer.
Figure 4:
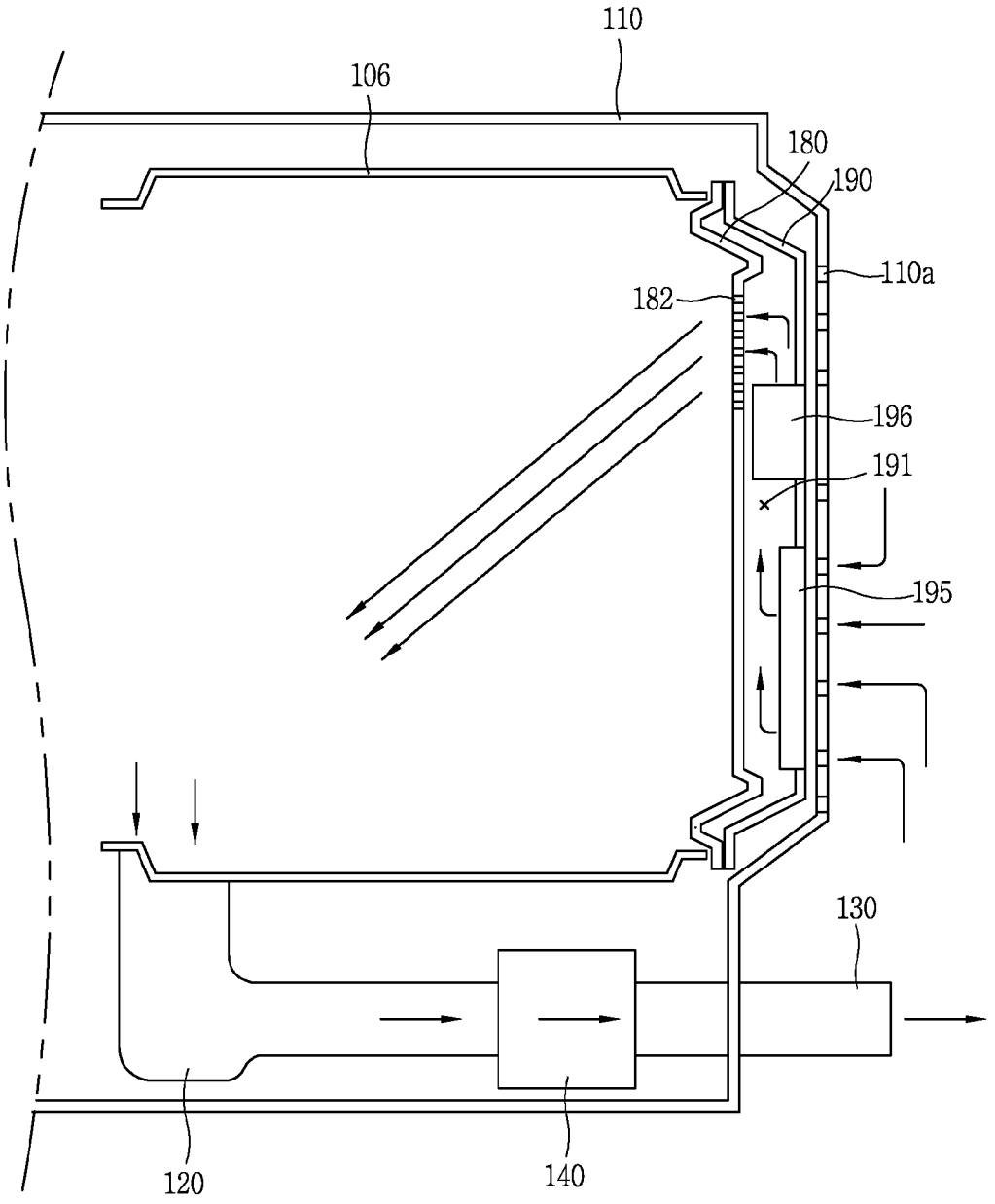
FIG. 4 is a cross-sectional view schematically illustrating example air flow.

FIG. 1 illustrates an example dryer, FIG. 2 illustrates the internal structure of the example dryer, and FIG. 3 is an exploded perspective view illustrating the internal structure of the example dryer. Referring to FIGS. 1 through 3, the dryer 100 may include a cabinet 110 corresponding to the body of the dryer. The cabinet 110 has a substantially hexahedral shape. A manipulation panel 102 for controlling the function of the dryer and displaying the status is located at an upper side of the front side portion, and a door 104 for loading an object to be dried is installed at a lower portion of the manipulation panel 102.

Referring to FIG. 2, a drum 106 having an inlet 106*a* configured to be open or closed by the door 104 is rotatably mounted to the cabinet 110. Furthermore, a fan housing 120 connected to communicate with an internal space of the drum 106 is located at a lower portion of the front surface portion of the drum 106, and a fan 122 is provided within the fan housing 120. The fan 122 has the form of a centrifugal fan to inhale air within the drum 106 and ventilate the air to an evaporator housing 130 which will be described in more detail later.

Furthermore, a filter assembly for filtering out foreign substances, such as lint or the like, which are released from the clothes loaded into the drum, is installed within the fan housing 120.

As illustrated in FIG. 3, the evaporator housing 130 may include a lower casing 130*a* fixed to the bottom surface of the cabinet and an upper casing 130*b* coupled to the lower casing 130*a* to form the evaporator housing. The evaporator housing 130 functions as an exhaust duct for transferring air within the drum to the outside of the cabinet, and the evaporator housing 130 may include duct portions 132*a*, 132*b* coupled to one side end portion of the fan housing 120. Furthermore, the evaporator housing 130 may also include an evaporator accommodation portion 134 for accommodating an evaporator 140, which will be described in more detail later.

As one constituent element configured to form the heat pump, the evaporator 140 may perform the role of collecting thermal energy contained in the exhausted air to evaporate refrigerant. To this end, the evaporator 140 is extended up to the ducts portions 132*a*, 132*b* to allow the exhausted air to flow through the evaporator 140. Furthermore, a bracket fixing portion 136 for allowing a fixing bracket, which will be described in more detail later, to be fixed is located at a rear end portion of the evaporator accommodation portion 134. The bracket fixing portion 136 has a rectangular cross-sectional shape protruded from the evaporator accommodation portion 134, and thus the fixing bracket may be inserted therein to stably support the fixing bracket.

Referring again to FIG. 2, a compressor housing 150 is installed at a location adjacent to the evaporator housing 130. The compressor housing 150 has a substantially hexahedral shape, and a compressor 160 configured to form a heat pump along with the evaporator is installed in a fixed manner at a substantially central portion thereof. Accordingly, the evaporator and compressor are fixed to the bottom surface of the cabinet 110 by the evaporator housing and compressor accommodation portion.

In addition, a bracket fixing portion 152 configured to fix the fixing bracket is also installed at a rear end portion of the compressor housing 150 similarly to the evaporator housing. Here, a plurality of ribs 152*a* are formed at an outer circumferential portion of the bracket fixing portion 152 to enhance the strength of the bracket fixing portion 152, and it is the same at a bracket fixing portion provided in the evaporator housing.

Referring to FIGS. 2 and 3, the fixing bracket 170 may have a bar shape vertically extended along the height direction of the cabinet 110. An end portion of the fixing bracket 170 is fixed in the state of being inserted into the bracket fixing portions 136, 152, and the other end portion thereof is fixed to a plate member, which will be described in more detail later, to support the plate member.

Furthermore, a plurality of slits 110*a* are formed at a rear surface of the cabinet 110 to inhale external air into the internal space of the cabinet. The plurality of slits are disposed along the rear surface of the cabinet 110, and the slits may be disposed at regular intervals or disposed at different intervals. For example, the slits may be disposed to have smaller intervals at a portion facing an inlet, which will be described in more detail later.

Additionally, the rear surface plate 180 is brought into contact with the drum 106, thereby preventing an object to be dried loaded into the drum from being released from the drum. A plurality of through holes 182 are formed at an upper portion of the rear surface plate 180 to inhale hot air into the drum.

Furthermore, a plate member 190 facing the rear surface plate 180 is installed therein. Though an outer circumferential portion of the plate member 190 is brought into contact with the rear surface plate 180, a central portion thereof is separated from the rear surface plate to have a predetermined distance. Due to this, a space is formed between the rear surface plate and the plate member, wherein the space forms an intake passage 191 configured to inhale air inhaled through the slits 110A into the drum.

Specifically, the inlet 192 having a rectangular shape is formed at the plate member 190, wherein the inlet 192 is formed to inhale air existing within the cabinet into the intake passage. A condenser 195 is installed on the inlet 192. Accordingly, air (e.g., all air) inhaled through the inlet 192 passes through the condenser 195 and then is inhaled into the intake passage.

Furthermore, a heater installation portion 194 is formed at an upper portion of the rear surface plate 180, and a heater 196 is installed within the heater installation portion 194. The heater 196 is heated by electrical energy or the like, and configured to additionally heat air that has passed through the condenser 195. In this regard, the heater 196 is located at a downstream side of the condenser on the intake passage.

When a user loads clothes into the drum and then operates the heat pump, the heat pump starts its operation while operating the compressor 160. Due to operation of the compressor 160, refrigerant passing through the condenser becomes a high temperature state and refrigerant passing through the evaporator maintains a low temperature state.

When the fan 122 is operated, a negative pressure is formed within the drum to start the flow of air. For operation of the fan 122, external air located at the rear surface side of the cabinet is inhaled through the slits 110*a* and then inhaled into the intake passage through the inlet 192.

In some implementations, the size of the condenser is formed to have the substantially same size as the inlet 192. Accordingly, in these implementations, all the air inhaled through the inlet 192 exchanges heat with refrigerant at high temperature while passing through the condenser. In dryers in which the condenser is located at the bottom surface of the cabinet, increasing the inlet of the intake passage to a sufficient extent may not be possible. In some cases, an overall area of the condenser is decreased and the length thereof is relatively increased, and thus the flow rate of air is decreased as well as reducing the thermal transfer efficiency due to the flow resistance. However, according to the dryer 100, the overall area of the condenser may be sufficiently increased to reduce the thickness of the condenser. In some examples, flow resistance by the condenser may be drastically reduced and thermal transfer efficiency also may be increased.

In addition, the inlet is disposed adjacent to the rear surface of the cabinet, and thus most of air inhaled through the inlet may be inhaled from the rear surface of the cabinet, and air inhaled from the inside of the cabinet becomes very small. Thus, the inhaling of foreign substances, such as dust or the like, which exist within the cabinet, into the drum is reduced (e.g., minimized), and air is inhaled from the rear surface of the cabinet with a relatively small amount of foreign substances compared to the bottom surface inhalation. Thus, the concern of duct clogging or the like due to the inhaling of foreign substances even with no installation of a filter may be reduced.

Figure 5:
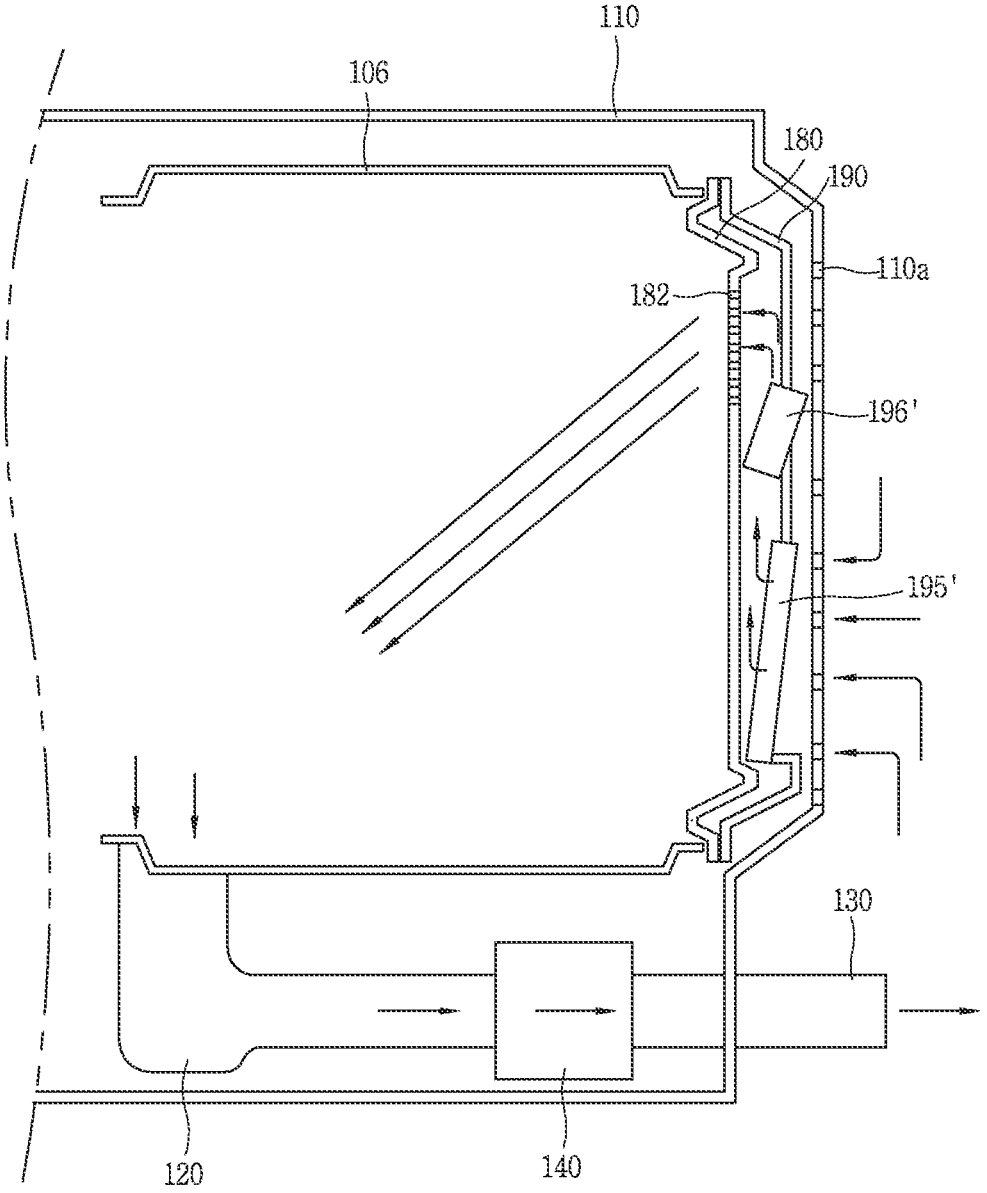
FIG. 5 is a cross-sectional view schematically illustrating further example air flow.

When the area of the condenser is greater than that of the inlet, an example in which the condenser is disposed in an inclined manner to the inlet may be used as shown in FIG. 5. Referring to FIG. 5, the condenser 195' is disposed clock-wisely inclined. By disposing the condenser 195' in such a manner, a larger condenser can be accommodated in a small area, and then heat transfer efficiency could be enhanced. The inhaled air is heated to have a temperature required for drying while passing through the heater 196. If sufficient amount of air can be heated only with the condenser, then the heater may not be operated or the heater may not be installed.

Further, the heater 196' is also disposed in an inclined manner.

The generated hot air is inhaled into the drum through the through hole 182 to dry objects and then inhaled into the fan housing 120 and then cooled and condensed in heat exchange with the evaporator 140, and exhausted to the outside of the cabinet through the evaporator housing.

As described above, since no fan pumps air into the drum, the internal pressure of the drum maintains a state of being the same as or lower than the external pressure, and thus the internal pressure of the drum maintains a state of being the same as or lower than the inside of the cabinet even when the fan housing or evaporator housing is clogged. Accordingly, humid air within the drum may not be drained into the cabinet, thereby effectively preventing a condensation phenomenon.

What is claimed is:

1. A dryer, comprising:

a cabinet;

a drum installed within the cabinet and that includes an opening that is configured to receive objects to be dried;

an exhaust duct configured to exhaust air from the drum to outside of the cabinet;

a fan configured to inhale air from the drum and pump the air to the exhaust duct;

an evaporator configured to exchange heat with air being exhausted through the exhaust duct;

a condenser disposed behind a rear side of the drum that is opposite of a front side of the drum in which the opening is defined;

an intake passage having an inlet configured to inhale air that has passed through the condenser into the drum;

a compressor and an expansion apparatus configured to define a heat pump along with the evaporator and condenser; and a plate member located at the rear side of the drum and that is configured to define the intake passage, wherein the inlet is provided at a lower portion of the plate member to face a rear surface of the drum, wherein the condenser is mounted on the plate member through the inlet, and wherein a heater is mounted on an upper portion of the plate member to further heat air that has been heated by the condenser.

2. The dryer of claim 1, wherein the condenser is disposed between the rear surface of the drum and a rear surface of the cabinet.

3. The dryer of claim 1, further comprising:

a bracket configured to fix the condenser to the rear surface of the drum or the rear surface of the cabinet.

4. The dryer of claim 1, wherein the condenser is disposed in an inclined manner relative to the rear surface of the drum or a rear surface of the cabinet.

5. The dryer of claim 1, wherein the plate member disposed to face the rear surface of the drum and define the intake passage between the rear surface of the drum and the plate member.

6. The dryer of claim 5, further comprising:

an evaporator housing that houses the evaporator and that is fixed to a bottom surface of the cabinet; and a compressor housing that houses the compressor and that is fixed to the bottom surface of the cabinet.

7. The dryer of claim 6 a pair of fixing brackets extending along a height direction of the cabinet, wherein the pair of fixing brackets are fixed to the evaporator housing or compressor housing, respectively to support the plate member.

8. The dryer of claim 1, wherein a plurality of slits are defined in a rear surface of the cabinet, and wherein air enters the cabinet through the plurality of slits, passes through the condenser, and enters the intake passage after passing through the condenser.

9. The dryer of claim 1, further comprising a heater is disposed at a downstream side of the condenser.

10. The dryer of claim 9, wherein the heater is disposed in an inclined manner relative to the rear surface of the drum or a rear surface of the cabinet.

11. A dryer, comprising:

a cabinet;

a drum installed within the cabinet and that includes an opening and that is configured to receive objects to be dried;

a condenser installed behind a rear side of the drum that is opposite of a front side of the drum in which the opening is defined, the condenser being configured to heat air inhaled from a rear surface of the cabinet;

a fan disposed under a lower side of the drum and configured to inhale and exhaust air within the drum;

a fan housing that accommodates the fan and communicates with the drum;

an evaporator housing coupled to the fan housing and configured to guide the exhausted air out of the cabinet;

a compressor housing disposed at one side of the evaporator housing;

an evaporator accommodated in the evaporator housing and configured to exchange heat with air being guided by the evaporator housing;

a compressor accommodated in the compressor housing;

an intake passage having an inlet configured to inhale air that has passed through the condenser into the drum;

a plate member located at the rear side of the drum and configured to define the intake passage, and a pair of fixing brackets fixed to the evaporator housing or compressor housing respectively, and configured to support the plate member, wherein the inlet is provided at the plate member to face a rear surface of the drum, and wherein the condenser is mounted on the plate member through the inlet, and wherein the plate member is disposed to face the rear surface of the drum.

12. The dryer of claim 11, further comprising a bracket fixing portion to which the pair of fixing brackets are inserted and fixed, the bracket fixing portion being located in the evaporator housing or compressor housing.

13. The dryer of claim 11, wherein an outer circumferential portion of the plate member is brought into contact with the rear surface of the drum.

14. The dryer of claim 13, wherein the plate member is fixed to the rear surface of the drum or the rear surface of the cabinet.

15. The dryer of claim 11, further comprising:

a heater installed within the intake passage and configured to further heat air heated by the condenser.

16. The dryer of claim 15, further comprising a heater installation portion that accommodates the heater and that is located at an upper side of the inlet.

* * * * *